United States Patent [19]

von Colson

[11] 4,334,405

[45] Jun. 15, 1982

[54] STATOR SECTION FOR A SPINDLE, MORE ESPECIALLY A TWO-FOR-ONE SPINNING OR TWISTING SPINDLE

[75] Inventor: Godehard von Colson, Kempen, Fed. Rep. of Germany

[73] Assignee: Palitex Project-Company GmbH, Krefeld, Fed. Rep. of Germany

[21] Appl. No.: 176,703

[22] Filed: Aug. 11, 1980

[30] Foreign Application Priority Data

Sep. 29, 1979 [DE] Fed. Rep. of Germany ..... 2939645

[51] Int. Cl.[3] ..... D01H 11/00; D01H 7/86

[52] U.S. Cl. ..... 57/300; 57/306; 57/58.49

[58] Field of Search ..... 57/300–302, 57/306, 58.49

[56] References Cited

U.S. PATENT DOCUMENTS

| | | | |
|---|---|---|---|
| 3,312,051 | 4/1967 | Schumann et al. | 57/306 X |
| 3,360,915 | 1/1968 | Franzen | 57/58.49 |
| 3,439,486 | 4/1969 | Klein | 57/58.49 |
| 3,494,119 | 2/1970 | Ratti | 57/58.49 X |
| 3,546,871 | 12/1970 | Ratti | 57/58.49 |

FOREIGN PATENT DOCUMENTS

| | | | |
|---|---|---|---|
| 2708553 | 8/1978 | Fed. Rep. of Germany | 57/300 |

*Primary Examiner*—Donald Watkins

[57] ABSTRACT

There is described a stator section, for a spindle which has a spindle rotor at least partly enclosing the stator section, wherein the stator section incorporates, in the region occupied by surfaces situated opposite the spindle rotor, a dust and thread catching means. To provide this means, parts of surfaces of the stator lying opposite the rotor may be roughened. For this purpose the stator may be provided with grooves having mechanically-roughened surfaces or may have wound around it a strip of Velcro or strip of some other material, whereby the foreign bodies which are carried by the air, which flows through the rotor on the counter-current principle, collect on the said roughened parts of the surface of the stator or on said strip, as a result of which the foreign bodies are prevented from reaching the region occupied by a spindle bearing arrangement. In the arrangement shown, a thread package carrier 7 of the stator section of a two-for-one twisting spindle has dust and thread catching means in the form of circumferential grooves 14 having surfaces of increased roughness.

8 Claims, 3 Drawing Figures

STATOR SECTION FOR A SPINDLE, MORE ESPECIALLY A TWO-FOR-ONE SPINNING OR TWISTING SPINDLE

The invention relates to a stator section for a spindle, more especially a two-for-one spinning or twisting spindle, which has a spindle rotor at least partly enclosing the stator section.

Two-for-one twisting spindles or two-for-one spinning spindles in particular differ fundamentally from conventional kinds of spindle in that they consist of a rotating section and a stationary section, which latter is generally held immobile by permanent magnet means. Depending upon the design of the spindle, the gap in this case between the rotating section of the spindle (the spindle rotor) and the stationary section of the spindle (the stator section) is formed to be of a specific geometrical configuration.

It is well-known that the rotor of a two-for-one spindle acts like a centrifugal blower. When it does so, not only may air be fed through a guide passage for the thread in a thread storage member but also a major amount of air flow may be set up at external contours as they rotate, i.e., air may flow along contours of the rotor of the spindle. This is also true of the space which exists between the rotor of the spindle and the faces of the stator section which lie opposite it. In this case the air in the outer region of the spindle may flow through a gap between the outer periphery of a package carrier, which is stationary, and a portion of greatest outer diameter of a rotary plate which may form part of the spindle rotor.

The air flow in this case takes place along the contours of the stationary section and is diverted upwards again in the opposite direction of flow by the inside contour of the rotating section. Thus, it flows out again through the gap between the outer circumference of the stationary package carrier and the portion of greatest outer diameter of the said plate of the rotor. This flow of air also carries with it all the floating material present in the atmosphere surrounding the spindle including dust particles and fluff.

In some instances, entire pieces of thread, particularly if the thread breaks in the outer region where the balloon is situated, these pieces of thread may be taken hold of by the flow of air described above and sucked into the open space between the stationary and rotating sections of the spindle. The further the point at which the thread breaks, from the rotor of the spindle, the longer is the piece of thread which drops back onto the rotor. This may happen fairly often, which means that in the course of time a considerable amount of material finds its way into this space.

However, this creates a condition which is very serious for an upper bearing arrangement of a two-for-one spindle. The remnants of thread and other foreign bodies may be picked up by cage means in the bearing arrangement and become churned into said bearing arrangement. This inevitably results in the upper bearing arrangement of the spindle seizing. The result is that the package carrier also rotates and, not being balanced, it and the package resting on it may represent a considerable source of danger to the area surrounding the spindle and in particular to operators.

Attempts have already been made to find some remedy for this, in the form of labyrinths or encapsulated bearings. Use has also been made of means for catching and holding the stationary section when it is forced to rotate in the event of seizure. However, these arrangements do not provide a complete remedy and are therefore not sufficiently certain. In addition, they are expensive and cause an increase in cost of the spindle structure.

The object of the invention is, in a spindle having stator and rotor section, to form the stator section in particular in such a way that thread residue or other unwanted solid material is caught before it enters the region occupied by the upper bearing arrangement of the spindle.

In accordance with the invention, this object is achieved in a stator section of a spindle by having the stator section incorporate a dust and thread catching means in the region occupied by surfaces situated opposite the spindle rotor.

In preferred embodiment of the invention, the said dust and thread catching means comprise in essence at least one groove arranged in the outer periphery of the stator section. Such a groove or grooves on the one hand prevent the incoming air from flowing under laminar conditions and on the other hand trap pieces of thread or dust particles which are drawn in with the air. However, since smooth grooves in materials with a uniform surface finish would hold the threads to only a limited degree, preferably each peripheral groove has a surface of increased roughness. As an example, the plastics industry today offers suitable materials which, after mechanical treatment, are sufficiently rough for the intended application. Such materials are for example foamed materials, generally polyurethane based. Parts which are molded from such material have a smooth outer skin produced by the mold. Not until the surface has been worked on mechanically is the open-pored structure, which provides a higher level of roughness, restored.

In a further embodiment of the invention provision is made for a strip of Velcro or an adhesive strip to be fitted around the outer periphery of the stator section.

Practical tests have confirmed the effectiveness of the measures described above. To ensure that the dust and thread catching means remain operational for an extended period, the said means should be cleaned, i.e. freed of the particles of dust and thread which it has trapped, at specified intervals.

Apart from being used in two-for-one spindles, a stator section in accordance with the invention can also be employed in so-called cabling spindles, such as are described in German Offenlegungsschrift No. 27 26 603 for example.

BRIEF DESCRIPTION OF DRAWINGS

In the accompanying drawings, which show, by way of example, two embodiments of the invention.

DETAILED DESCRIPTION OF PREFERRED EMBODIMENT OF THE INVENTION

Figure 1:
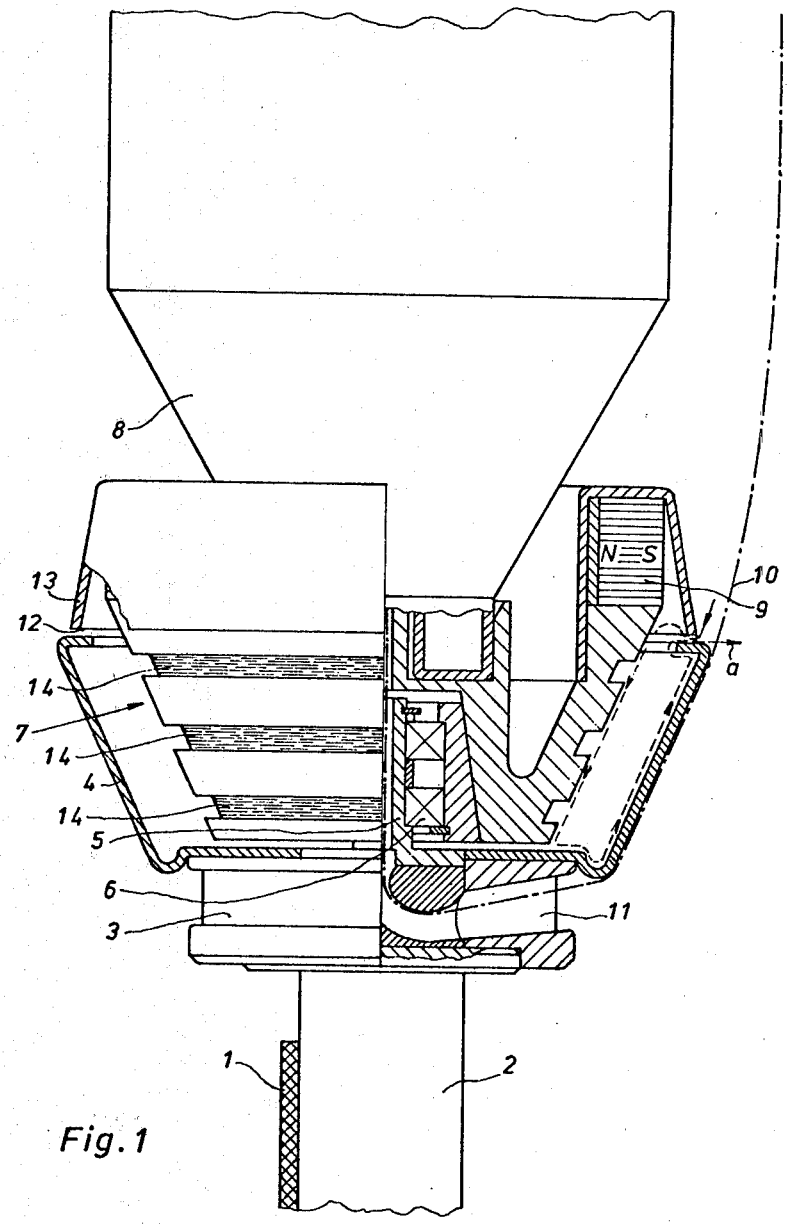
FIG. 1 is a diagrammatic sectional view of part of a two-for-one twisting spindle having a stator section constructed in accordance with the invention.

Referring to the drawings, a two-for-one twisting spindle, of which part is shown in FIG. 1, comprises a wharve 2 which is driven by a tangential belt 1, a thread storage disc 3 which has a rotary plate 4 fastened to it, and a supply package carrier 7, which is mounted on a hollow shaft 5 of the spindle by means of a bearing arrangement 6 and which carries a supply package 8.

Thus, the rotor of the spindle comprises in essence the wharve 2, the thread storage disc 3, the rotary plate 4 and the hollow shaft 5 of the spindle, while the stator section comprises in essence the supply package carrier 7, which is fitted with immobilizing magnets 9 which are associated with immobilizing magnets (not shown) situated in fixed positions outside the spindle to prevent the supply package carrier from rotating.

The thread is taken upwards from the supply package 8 and travels down through the center of said supply package 8 and the hollow shaft 5 of the spindle to the thread storage disc 3, from which it emerges radially through a thread-guiding passage 11 and from which it is conducted upwards, while forming a balloon, to a guide loop (not shown) which defines the topmost point of the balloon.

From this point, the thread runs to a take-up device which is not shown.

The outer circumference of the rotary plate 4 is substantially of a bowl form which is open at the top and the upper edge of which, in conjunction with a downwardly directed coned annulus 13 on the supply package carrier 7 of the stator section, defines and annular gap 12.

The outer periphery of the supply package carrier of the stator section is provided with a plurality of circumferential grooves 14 having surfaces of increased roughness. The surface roughness is produced in the manner described above by mechanical processing of, for example, a foamed material, such as a polyurethane based material for example.

When the spindle is operating, i.e. when the rotor is revolving, centrifugal force creates in the space between the stator section 7 and the rotor of the spindle an air flow which is represented by the arrows a and which carries in it the suspended material present in the vicinity of the spindle in the form of dust particles and fluff. This suspended material is trapped in the region occupied by the grooves 14, thus preventing such material, in the form of dust or fluff, from reaching the region occupied by the bearing arrangement 6 and thus also preventing pieces of thread from being drawn in as described above.

Figures 2, 3:
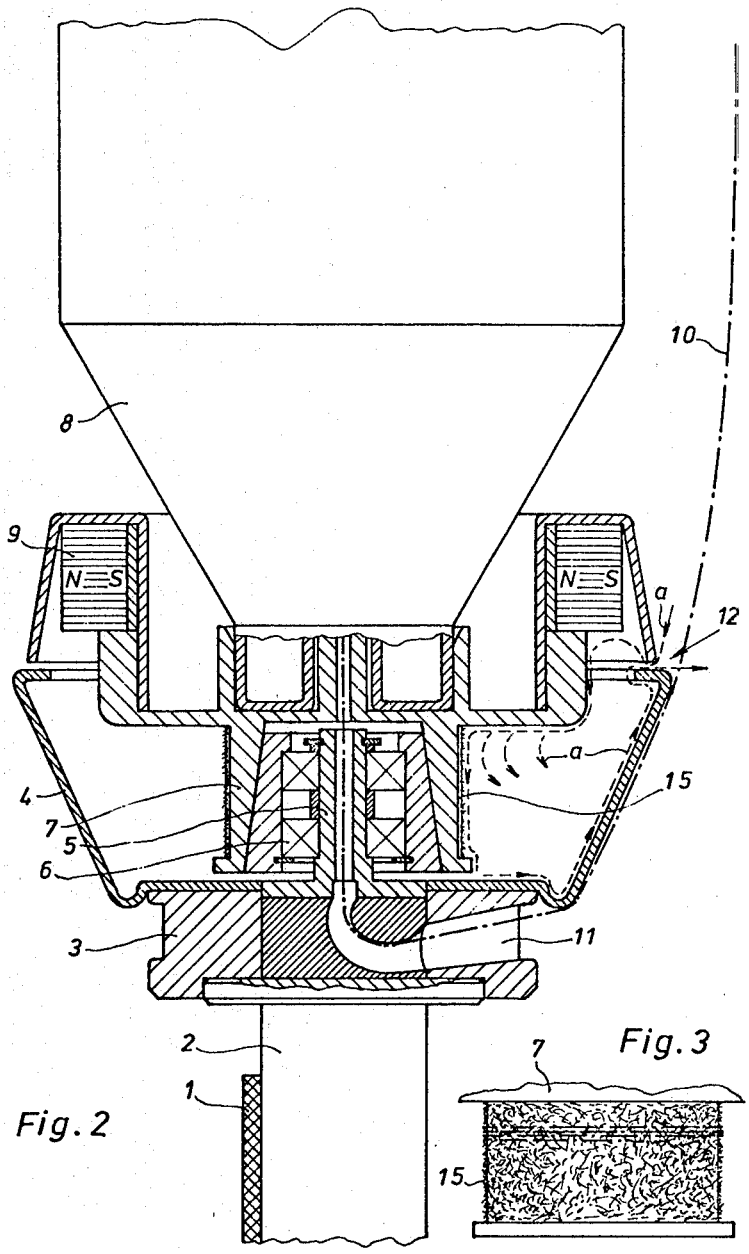
FIG. 2 is a view comparable to the view in FIG. 1 showing a modified embodiment of stator section constructed in accordance with the invention.
FIG. 3 is a side elevation of a region of stator section, shown in FIG. 2, provided with a strip of velcro.

In the embodiment shown in FIGS. 2 and 3, a strip 15 of Velcro is wound around the outside circumference of the stator supply package carrier 7 of the stator section and this strip acts as a dust and thread trapping means to prevent dust particles or ends of thread from reaching the region occupied by the bearing arrangement 6. If required an adhesive tape or the like may be substituted for the strip of Velcro 15.

I claim:

1. A two-for-one spinning or twisting spindle comprising; spindle bearings for supporting said spindle for rotation, said spindle having a stator section and a spindle rotor at least partly enclosing said spindle section, said stator section having surfaces thereon located opposite said spindle rotor, and catching means for retaining and collecting fluff, threads and other foreign particles carried by ambient air thereby preventing said particles from reaching said spindle bearings.

2. A two-for-one spinning or twisting spindle as claimed in claim 1, said stator section catching means having at least one circumferential groove in the outer periphery of said stator section.

3. A two-for-one spinning or twisting spindle as claimed in claim 2, said stator section catching means circumferential groove having increased surface roughness.

4. A two-for-one spinning or twisting spindle as claimed in claim 1, wherein said stator section catching means includes a surface of increased thread adhesive and retaining capacity.

5. A two-for-one spinning or twisting spindle as claimed in claim 4, and wherein said catching means surface is cylindrical.

6. A two-for-one spinning or twisting spindle as claimed in claim 4, and wherein said stator section catching means surface includes a strip of Velcro material.

7. A two-for-one spinning or twisting spindle as claimed in claim 4, and wherein said stator section catching means surface includes a strip of adhesive material.

8. A two-for-one spinning or twisting spindle having a spindle rotor, bearings for rotatably supporting said spindle, said spindle rotor having a spindle section at least partly enclosing said stator section, said stator section have a surface spaced from said spindle rotor including a dust and thread catching means for retaining and collecting fluff and other foreign particles carried by the ambient air thereby preventing said particles from reaching said spindle bearings, said dust and thread catching means having at least one circumferential cylindrical groove in its outer periphery, said circumferential groove having an increased surface roughness for catching and retaining threads, fluff and other foreign particles.

* * * * *